United States Patent [19]

Blanchard et al.

[11] 4,380,692

[45] Apr. 19, 1983

[54] ROLLER BAND SENSOR

[75] Inventors: Houston F. Blanchard, Santa Barbara; Lawrence D. Tuchscherer, Goleta, both of Calif.

[73] Assignee: General Motors Corporation, Detroit, Mich.

[21] Appl. No.: 266,081

[22] Filed: May 20, 1981

[51] Int. Cl.[3] ..... H01H 35/14

[52] U.S. Cl. ..... 200/61.45 R; 200/61.53; 200/DIG. 45

[58] Field of Search ..... 200/61.45 R, 61.53, 200/DIG. 45

[56] References Cited

U.S. PATENT DOCUMENTS

| | | | |
|---|---|---|---|
| 3,452,175 | 6/1969 | Wilkes | 200/DIG. 45 |
| 3,467,139 | 9/1969 | Richards | 200/DIG. 45 |
| 3,546,925 | 12/1970 | Barton | 200/DIG. 45 |
| 4,157,462 | 6/1979 | Blanchard | 200/61.45 R |
| 4,203,015 | 5/1980 | Tuchscherer | 200/61.45 R |

*Primary Examiner*—J. R. Scott

*Attorney, Agent, or Firm*—Herbert Furman

[57] ABSTRACT

A roller band sensor includes a housing having a cavity including a pair of spaced generally parallel side walls joined by proximal and distal end walls. A pair of bands of flexible spring material within the housing cavity are of generally elongate shape, with their adjacent abutting portions commonly secured to each other and their respective remote portions bearing against and secured to a respective side wall to divide each band into forward and rearward end loops. The forward end loops each include symmetrical shape tapered sections contiguous the secured remote portions and the rearward end loops each include symmetrical shape tapered sections contiguous their secured adjacent portions to obtain a predetermined spring rate and preload normally locating the bands in a preload position unless the bands are subjected to a predetermined velocity or acceleration change whereupon the bands concurrently roll relative to each other and along their respective side walls toward the distal end wall and into bridging engagement with contact structure.

5 Claims, 9 Drawing Figures

ROLLER BAND SENSOR

FIELD OF THE INVENTION

This invention relates generally to roller band sensors and more particularly to roller band sensors having effective varying width roller bands to attain predetermined spring rates and preloads.

BACKGROUND OF THE INVENTION

U.S. Pat. No. 4,157,462, Sensor, Houston F. Blanchard, issued June 5, 1979 and assigned to the assignee of this invention, discloses a roller band sensor which includes a pair of bands of flexible spring material of a generally figure-eight configuration which are constrained from their free shape to an elongate shape by the tapered side walls of a covered housing cavity. The adjacent abutting portions of the bands are commonly secured to each other and the respective remote portions of the bands are secured to a respective side wall of the housing. The integral biasing force of the bands tending to return to their free shape provides a preload force urging the bands toward the proximal end wall of the cavity to a preload position. When the bands are subjected to a predetermined velocity or acceleration change, the bands concurrently roll relative to each other and to a respective side wall of the cavity toward the distal end wall to actuated position wherein the bands engage contact means to actuate a device.

The factors which determine the movement of the bands to actuated position are: the natural frequency or spring rate of the bands, i.e. the predisposition of the bands to move when subjected to predetermined velocity or acceleration change; the preload; and the distance between preload and actuated positions. The desired preload and natural frequency are obtained by selection of the included angle between the side walls of the cavity and selection of the thickness of the bands. Air damping can be controlled through selection of clearances between the cavity covers and the band edges; notching or otherwise altering the profiles of the bands to provide air passages between the bands and covers; profiling the covers; or profiling the proximal end wall of the cavity.

U.S. Pat. No. 4,203,015, Roller Band Sensor Contact System, Lawrence D. Tuchscherer, issued May 13, 1980, and assigned to the assignee of this invention, discloses a roller band sensor having a contact system to eliminate contact bounce. Additionally, the Blanchard and Tuchscherer patents disclose various manners of avoiding interplay or substantial contact between the rearward arcuate walls of the cavity and the rearward loops of the roller bands to obviate such contact influencing the spring rate.

SUMMARY OF THE INVENTION

In the roller band sensor of this invention, the bands are constrained by the side walls of the cavity and the desired spring rate and preload are obtained by providing effective varying width symmetrical sections in like band loops, with such sections extending from contiguous the secured portions of the bands into the bend radius of the loops.

Although the side walls of the cavity are preferably generally parallel, such side walls may be tapered as disclosed in the aforenoted Blanchard and Tuchscherer patents. The tapered configuration of the side walls increases the range of spring rates and preloads which can be obtained in sensors of this invention.

The sections of like band loops are both symmetrical in shape and symmetrically located with respect to each other. However, such sections need not be symmetrical in shape with the sections in the other like band loops and are asymmetrically located with respect to the sections in such other like band loops. The varying width symmetrical sections in the forward loops of the bands extend from contiguous the remote secured portions of the bands into the bend radius of such loops. Likewise, the varying width symmetrical sections provided in the rearward loops of the bands extend from contiguous the abutting secured portions of the bands into the bend radius of such rearward loops. It is not necessary that the effective varying width symmetrical sections be provided in both the forward and rearward loops and need be provided only in one or the other like loops of the bands.

In the preferred embodiment of the invention, the effective varying width symmetrical section is attained by symmetrically cutting away opposite edge portions of the band to provide a tapered section which merges directly at its wider width end into the normal band edge portions or is joined thereto by lateral steps or edges. The narrow width end merges into a reduced width rectilinear section or island which is joined to the normal band edge portions by lateral steps or edges. The tapered section, the rectilinear section and all lateral steps or edges are symmetrical with respect to the longitudinal axis of the band. In the forward loops, the rectilinear sections are located contiguous the remote secured portions of the bands and the tapered sections increase in width as they extend into the bend radius of their respective forward end loops. In the rearward loops, the rectilinear sections are located contiguous the adjacent secured portions of the bands and the tapered sections increase in width as they extend into the bend radius of their respective rearward end loops. The rectilinear sections have no effect on the spring rate or preload but merely serve as connections between the narrow width ends of the tapered sections and the secured portions of the bands.

When the bands are constrained by generally parallel side walls of the cavity, the bands try to roll to a configuration in which the sections of the band being bent in like loops are the narrowest sections to thereby reduce the amount of bending energy in the band loops. This is in accordance with the principle that every band system which is allowed to roll between parallel constraining side walls tends to relax to a condition of least energy. By locating the tapered sections in the forward band loops with their narrower width ends adjacent the remote secured portions of the bands, the bands will try to roll toward the proximal end wall of the cavity. Likewise by locating the tapered sections in the rearward end loops with their narrow width ends contiguous the adjacent secured portions of the bands, the bands will also tend to roll in the same direction. Thus, the tapered sections in the forward and rearward band loops complement each other rather than oppose each other.

The spring rate and preload of roller band sensors are influenced by (1) substantial contact of the rearward loops of the roller bands with the rearward arcuate walls of the cavity and, (2) by the radius of such walls, which is set by the spacing of the side walls of the cavity. It is preferable that such contact be avoided as disclosed in the aforenoted Blanchard and Tuchscherer patents so that the spring rate and preload are influenced by other factors. In the sensor of this invention, the desired spring rate and preload can be adjusted to the desired values by adjusting the included angle between the edges of the tapered section; by adjusting the extent of the lateral steps or edges joining the wider width end of the tapered section to the normal band edge portions, or dispensing with such steps or edges; and by adjusting the extent or length of the tapered section.

The tapered sections in like band loops permit the desired selection of spring rate and preload while maintaining the housing at a minimum size.

Additionally, with the use of the tapered sections in either or both of the forward and rearward band loops, the restoring force of the bands increases generally in a nonlinear manner with movement of the bands to actuated position since the wider width portions of the tapered sections and the normal width band portions move into the bend radius of the band loops. Thus, more force is required to start or continue movement of the band system to actuated position. The force vs displacement curves for band systems with tapered sections will tend to flatten out and may even fall off negatively depending on the extent of the tapered sections into the bend radius of like loops in preload position.

The extent of the lateral steps or edges joining the wider width ends of the tapered sections to the normal band edge portions significantly influences the preload value. The greater the extent, the greater the preload value. The less the extent, the less the preload value. The minimum preload value can be obtained by entirely dispensing with the lateral steps or edges and directly merging the wider width ends of the tapered sections into the normal band edge portions.

The effective varying width sections can also be attained by providing symmetrical shape cut outs or openings in like band loops. Such openings would have tapered portions and rectilinear portions arranged in the same general manner as the tapered sections, i.e. the rectilinear portions are located contiguous the proper secured portions of the bands and the tapered portions extend therefrom into the bend radius of the band loops.

The primary feature of this invention is that it provides an improved roller band sensor wherein the bands are constrained by generally parallel side walls of the cavity and have effective varying width symmetrical sections in like loops thereof in order to obtain the desired spring rate and preload. Another feature is that the sections extend from contiguous the secured portions of like band loops into the bend radius of such band loops. A further feature is that, in one embodiment, the sections are tapered with their narrow width ends located contiguous the secured portions of like band loops and their wider width ends extending into the bend radius and joined to the normal band edge portions, with the tapered sections and the juncture thereof to the normal band edge portions being symmetrical about the longitudinal axis of the band. Still another feature is that, in another embodiment, the effective varying width sections are provided by cut outs in like band loops having tapered openings arranged in the same general manner as the tapered sections, with such openings being symmetrical about the longitudinal axis of the bands. Still a further feature is that the tapered sections may be joined at their wider width ends to the normal band edge portions by lateral steps or edges or may merge directly into the normal band edge portions depending on the desired preload value. Yet another feature is that the narrow width ends of the tapered sections are joined by rectilinear sections to the secured portions of like band loops, with such rectilinear sections having no effect on the spring rate or preload of the band system but providing for a setting of the desired length of the tapered sections.

BRIEF DESCRIPTION OF THE DRAWINGS

These and other features of the invention will be readily apparent from the following description and drawings wherein.

DESCRIPTION OF THE PREFERRED EMBODIMENTS

Figure 1:
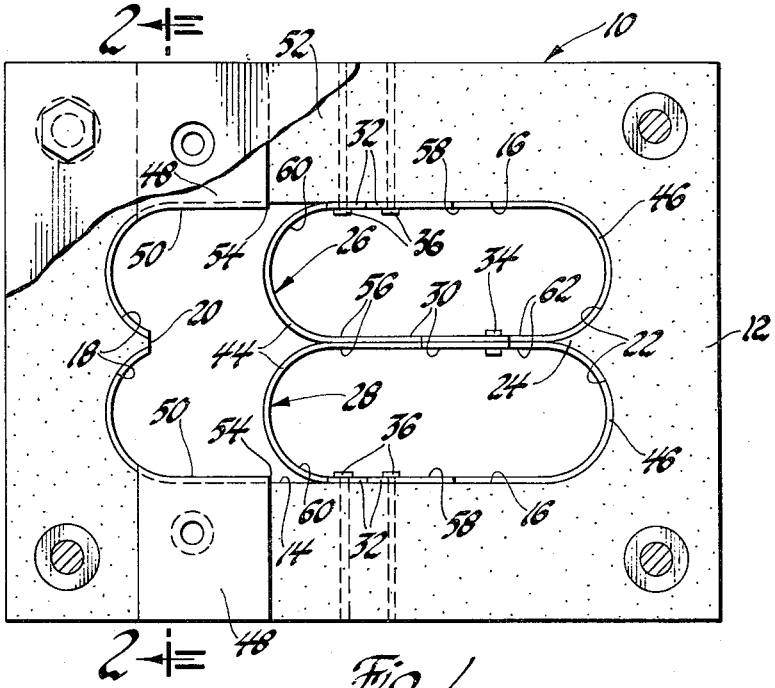
FIG. 1 is a partially broken away elevational view of a sensor according to one embodiment of this invention.
Figure 2:
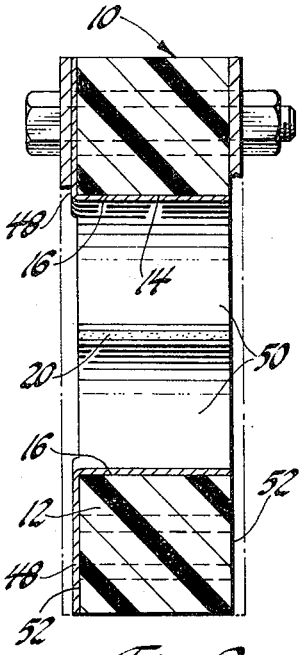
FIG. 2 is a sectional view taken generally along the plane indicated by line 2—2 of FIG. 1.
Figure 3:
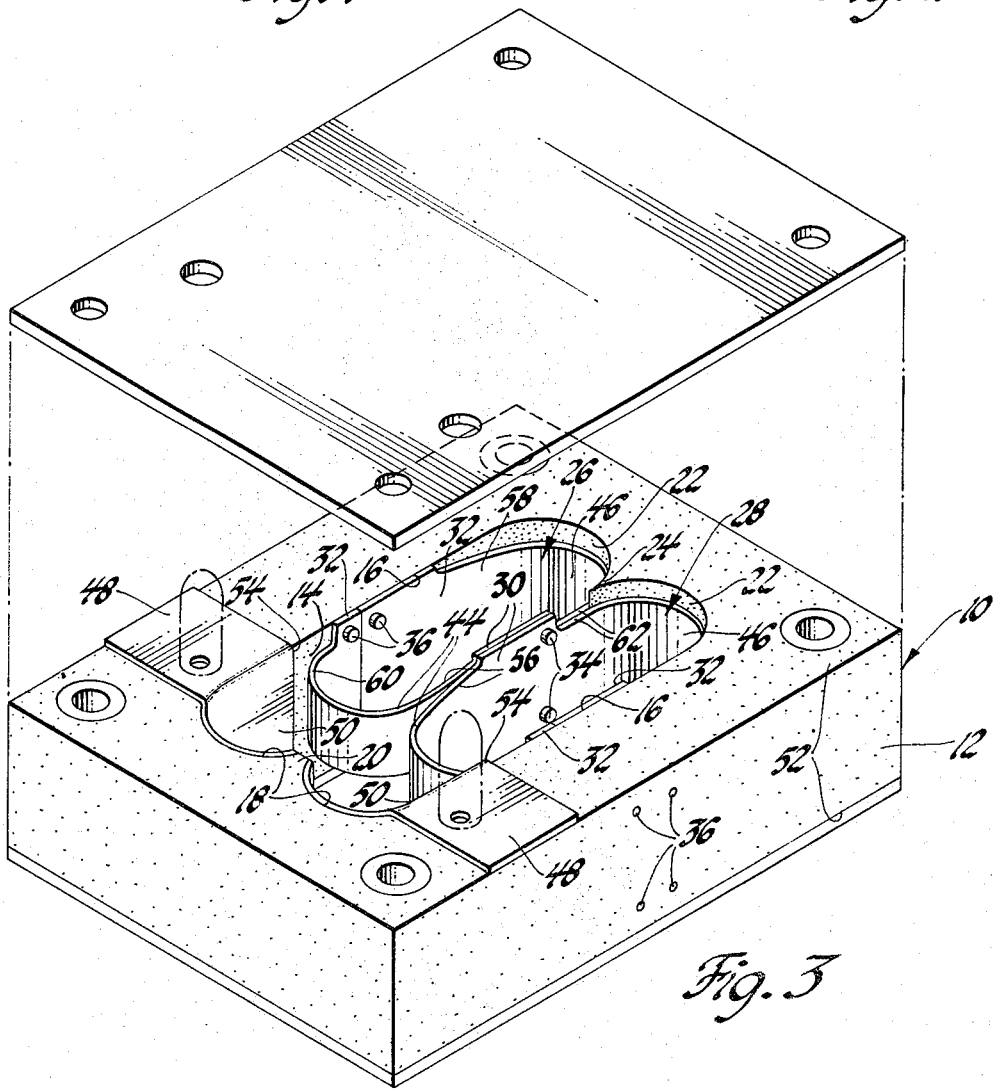
FIG. 3 is an exploded perspective view.

Referring to FIGS. 1, 2, 3 and 4 of the drawing, a sensor 10 according to this invention includes a housing 12 of electrically non-conductive material, such as fiber reinforced plastic, which is relatively stable as to shape and dimension under various ambient conditions.

The housing 12 includes a cavity 14 which is either molded or machined therethrough. The cavity 14 includes a pair of elongate bearing portions or side walls 16 which tangentially merge at their forward or distal ends into arcuate end walls 18. Walls 18 merge with each other at 20 and cooperatively define the distal end wall of cavity 14. The proximal or rearward ends of the walls 16 tangentially merge into arcuate end walls 22 which merge with each other at 24 and cooperatively define the proximal end wall of cavity 14. In the preferred embodiment shown, the side walls 16 are parallel to each other and to a bisector plane of the cavity through mergers 20 and 24 of the end walls 18 and 22 respectively. The side walls 16 may also be tapered with respect to each other as shown in the aforenoted Blanchard and Tuchscherer patents.

A pair of like bands 26 and 28 of planar or flat spring steel material are located within the cavity 14. The bands 26 and 28 are generally of figure-eight configuration and having adjacent abutting side portions 30 located planar with the bisector plane of the cavity and remote side portions 32 engaged in surface to surface relationship with a respective side wall 16.

The abutting portions 30 of the bands 26, 28 are commonly anchored to each other at 34 by rivets aligned transversely of the bands, and the remote side portion 32 of each band is also anchored at 36 to a respective side wall 16 by rivets aligned transversely of a respective band. The bands should not move relative to each other at the common anchor 34 and each band likewise should not move relative to a side wall 16 at a respective anchor 36.

Each band has effective continuity between its anchors 36 at a respective side wall and the common connection or anchor 34. In the embodiment shown, each band is formed of a strip of spring steel material, with the ends of the band abutting each other at anchors 36. The bands are formed of strips of precision ground high carbon spring steel, such as AISI 1095, having a thickness between 0.0020 inches to 0.0030 inches.

Although the bands 26, 28 are shown with the free edges of each abutting at the anchors 36, the bands may have other configurations as shown in the aforenoted Blanchard patent.

Each band 26, 28 in its free loop configuration has a generally circular shape. When the bands are disposed between the side walls 16 of the cavity 14, the band loops are forced or constrained to elongate and assume the shape shown in FIG. 1. The free figure-eight loop configuration is shortened along its major axis since the free length of the configuration is less than the distance between the side walls 16. The forward end loops 44 of each band tangentially merge with each other and with a respective side wall 16 and tangentially interconnect the adjacent and remote side portions 30, 32 respectively of each band, forwardly of anchors 34, 36. Likewise, the rearward end loops 46 of each band tangentially merge with each other and tangentially interconnect the adjacent and remote side portions 30, 32, respectively, of each band rearwardly of anchors 34, 36. The loops 44 and 46 of the bands have a bend radius of from 0.30" to 0.38" and are shown, for illustrative purposes only, in substantial contact with the end walls 18 and 22. As previously mentioned, the spring rate and preload would be influenced by such substantial contact, and therefore it should be avoided in various known manners as disclosed in the aforenoted Blanchard and Tuchscherer patents.

The bands 26, 28 provide a moving mass which is subject to a velocity change of predetermined extent and time or an acceleration of predetermined amplitude and time applied to the automobile or other article on which the sensor is mounted. This moving mass includes the weight of the adjacent butting side portions 30 of each of the bands; the weight of the rivets providing the anchor 34; the weight of the arcuate portions 44 between their lines of tangency with portions 30 and walls 16; and the weight of the arcuate portions 46 between their lines of tangency with portions 30 and walls 16. The moving mass is less than the total weight of the bands and the rivets providing anchor 34 and is of extreme light weight.

Figure 4:
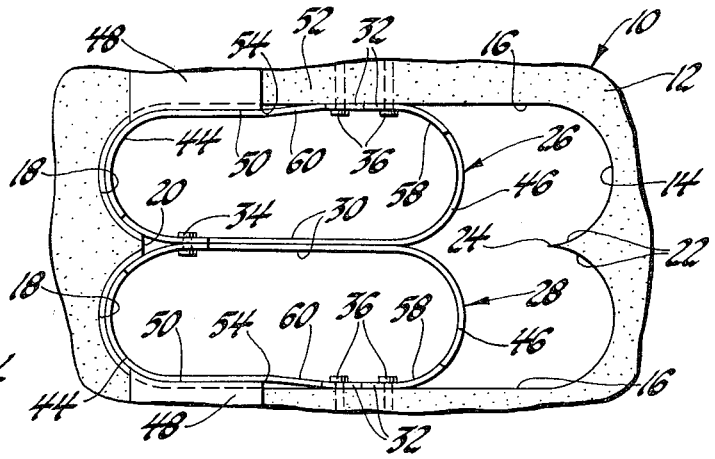
FIG. 4 is a view similar to FIG. 1 showing the sensor in actuated position.

When the bands 26, 28 move to actuated position shown in FIG. 4 wherein the arcuate portions 44 engage respective end walls 18, each band rolls oppositely of the other along a respective side wall 16 as abutting side portions 30 forwardly of anchor 34, tangentially merge into continuations of the forward loops 44 which continuously tangentially separate from each other and tangentially move into engagement with side walls 16 as continuations of remote side portions 30 forwardly of anchors 36.

Concurrently, the arcuate portions 46 tangentially merge into each other as continuations of abutting side portions 30 rearwardly of anchor 34 while remote side portions 32 tangentially separate from walls 16 rearwardly of anchor 36 and tangentially merge into continuations of rearward loops 46.

From the foregoing it can be seen that parts or areas of the abutting side portions 30 and remote side portions 32 of bands 26, 28 never respectively disengage from each other or wall 16 and are uninvolved at all times in the formation of loops 44 and 46. The anchors 34 and 36 should be located in such parts or areas to ensure that such anchors are never in or close to an area of tangential contact of the bands with each other or with walls 16 so as to affect the performance of the sensor. The transversely aligned rivets of anchor 34 need not be aligned with those of anchors 36, as shown, and the anchor 34 can be arranged in various relationships to the anchors 36. However, anchors 34 and 36 should not affect any tangential contact areas of the bands, either with respect to each other or walls 16, in any position thereof.

A thin angular electrical contact 48 is adhesively secured to a base wall 52 of housing 12 and includes a contact member 50 adhesively secured to each of the side walls 16. The contact member 50 covers a predetermined portion of the wall 16 and a respective end wall 18. In the specific embodiment shown, the contact member 50 is 0.001 inches thick and the adhesive securing the contact member to the walls 16 and 18 is of the same thickness. Thus, the rear or trigger edge 54 of each contact member 50 is slightly spaced, 0.002 inches, from a respective wall 16.

As the bands concurrently roll along their respective side walls 16 and elongate during movement to actuated position, no coulomb friction is generated although there may be a small amount of rolling friction. However, as each band engages the edge 54 of a respective contact member 50, the trigger position, some coulomb friction occurs. This is desirable at this position since the wiping contact insures increased electrical continuity between the band and the contact member. After this initial engagement at the trigger position, the bands continue to concurrently roll to actuated position, FIG. 4, and move across each of the contact members 50 in surface to surface engagement therewith.

As the bands move from preload to actuated position, the total distance of travel of the center of each loop 44 will be one-half the total distance of travel of the common anchor 34 between the bands.

Figure 5:
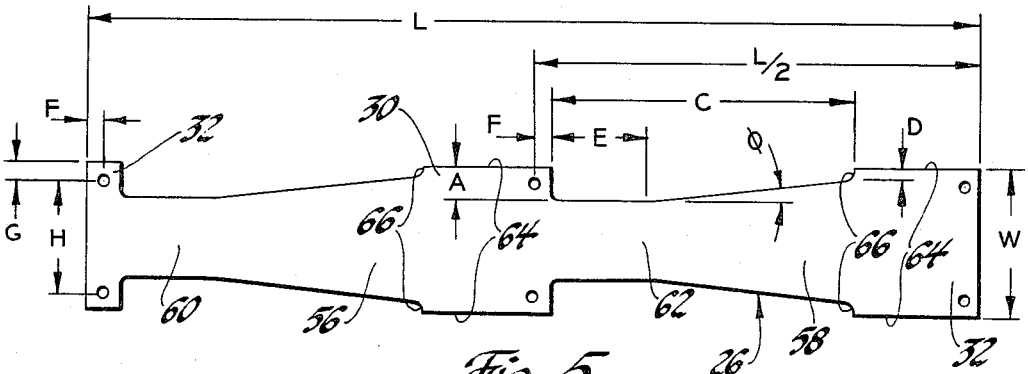
FIG. 5 is a view of a band of one embodiment.

FIG. 5 of the drawings shows the details of the band 26 shown in FIGS. 1–4. It will be understood that the details of the band 28 are the same. The band 26 includes the adjacent abutting portion 30 intermediate the ends thereof and the remote side portions 32 at each end thereof. When the bands 26 and 28 are installed within the cavity 14, the free edges of the remote side portions 32 abut at the anchors 36. The band 26 includes a tapered section 56 which forms part of the forward end loop 44 and a tapered section 58 which forms part of the rearward end loop 46. These tapered sections are of the same shape and are symmetrical about the center line of the band. However, as previously mentioned, these tapered sections need not be of the same shape and one may be dispensed with, provided, of course, that the tapered sections provided in the bands 26 and 28 are symmetrical with respect to each other and are symmetrically located in like end loops. The narrow width end of the tapered section 56 is joined to the left hand remote portion 32 by a rectilinear portion or island 60 and the narrow width end of the tapered section 58 is joined to the adjacent portion 30 by a similar island 62. The islands 60 and 62 are of the same shape and are also symmetrical about the center line of the band 26. The wider width ends of the tapered sections 56 and 58 are joined to the normal band edge portions 64 of abutting portion 30 and right hand remote side portion 32 by respective lateral steps or edges 66 of the same extent. As previously mentioned, the extent of such lateral steps or edges varies with the desired preload value and spring rate. The steps or edges can be entirely dispensed with, need only be provided at the wider width end of one or the other of the tapered sections 56 or 58, and the extent of such lateral steps or edges, if provided in conjunction with both tapered sections 56 and 58, need not be the same.

Certain of the dimensions of the bands 26 are indicated in FIG. 5. In the specific embodiment shown, the dimension L, the overall length, is 5.0" and can vary between 4.5" and 6.0". The dimension W, the overall width of portions 30 and 32, is 0.502" and can vary between this dimension and 0.506". The dimension C is 1.4" and can vary between 1.25" and 2.00". The dimension D, the extent of the lateral step or edge 66, is 0.07" and can vary from 0.00" to 0.10". The dimension A sets the lateral width of the islands 60 and 62 and is 0.10". This dimension can vary between 0.04" and 0.14". The angle $\phi$ is 2.5° and can vary between this value and 8°. The thickness of the band 26 is 0.002" and can vary between this value and 0.003". The value H is 0.375", the value G is 0.063" and the value F is 0.06", and the value E is 0.35".

Figure 6:
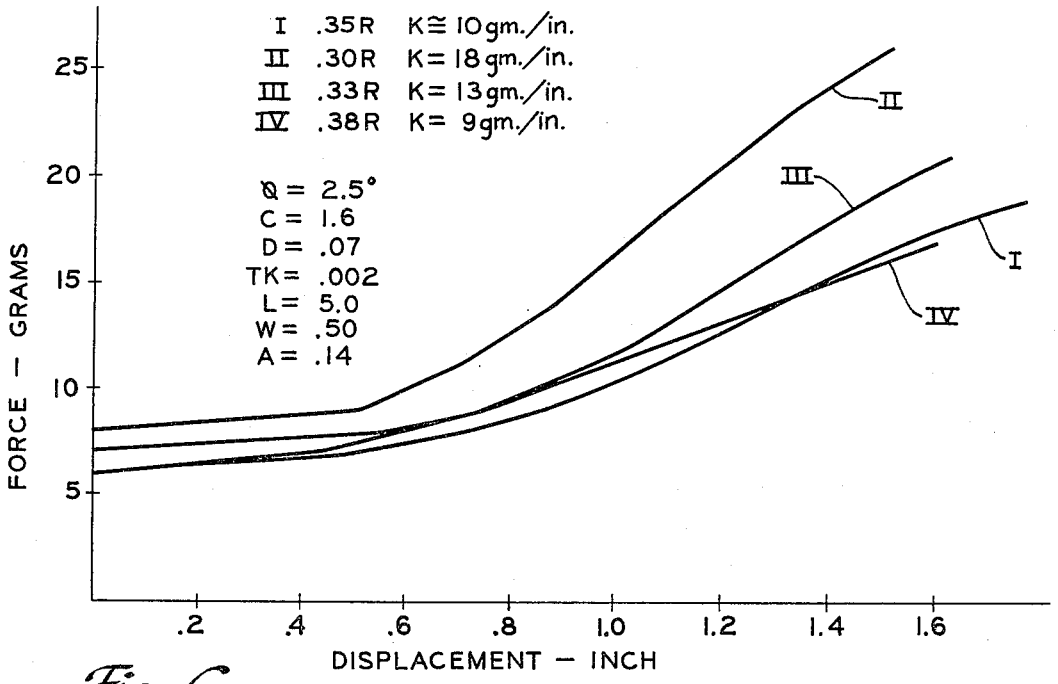
FIG. 6 is a diagram.

FIG. 6 is a force versus displacement diagram showing a number of force versus displacement curves obtained from a sensor 10 having bands 26 and 28 dimensioned as previously set forth in conjunction with FIG. 5, but with different bend radii. The curve I is for a sensor wherein the bend radius is 0.35". The spring rate is 10 grams per inch and the preload is from 8 to 11 grams. The remaining curves II, III, IV are for sensors 10 wherein the bend radius is respectively 0.30", 0.30", and 0.38", with the spring rates being respectively 18 grams per inch, 13 grams per inch and 9 grams per inch; and the preloads being respectively 10–15 grams, 9–14 grams, and 8–10 grams.

Figure 7:
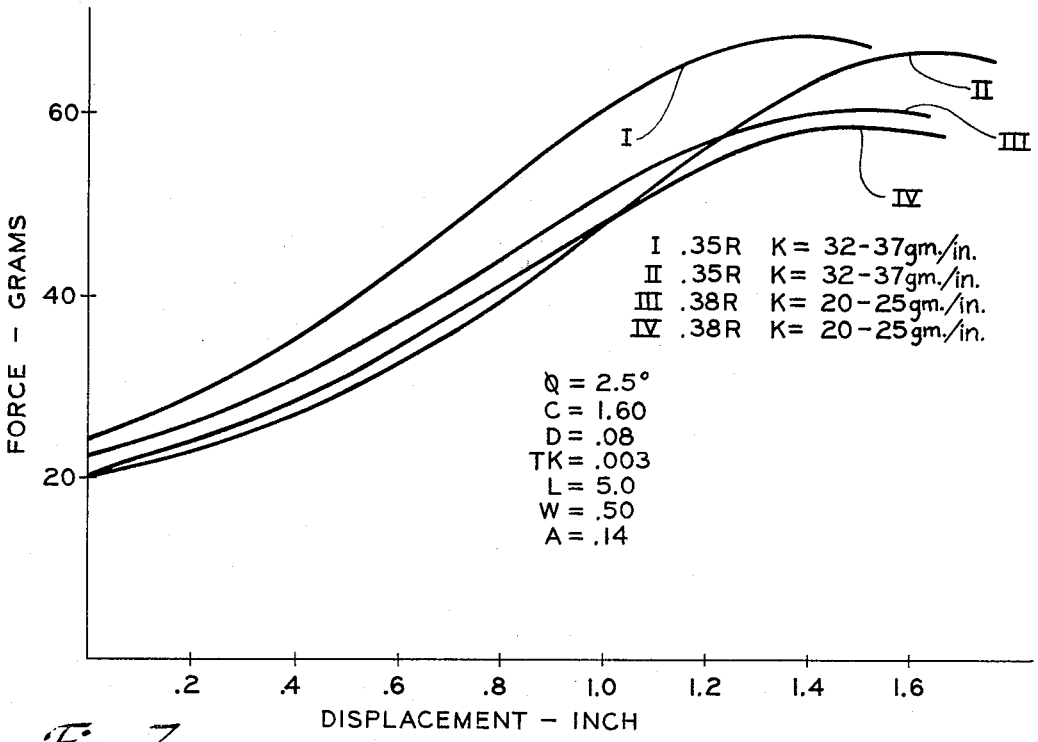
FIG. 7 is a diagram.

FIG. 7 is a force versus displacement diagram showing a number of curves obtained from a sensor 10 dimensioned substantially the same as previously set forth but with different bend radii, with the dimension D, the extent of the lateral step or edge, being 0.08" rather than 0.07" as in FIG. 6, and with the thickness being 0.003" rather than 0.002" as in FIG. 6. The curves I and II are for sensor 10 having a bend radius of 0.35". The respective spring rates are 33.2 and 36.6 grams per inch. The preload forces, K, are from 32 to 37 grams per inch. Curves III and IV are for sensors 10 having a bend radius of 0.38". The spring rates are respectively 20.9 grams per inch and 23.6 grams per inch. The preload forces, K, are from 20 to 25 grams per inch. Comparison of the diagrams of FIGS. 6 and 7 indicates that where the angle $\phi$ remains substantially constant and the extent of the lateral steps or edges, D, and the thickness of the band are both increased, the spring rates and preload values substantially increase.

Figure 8:
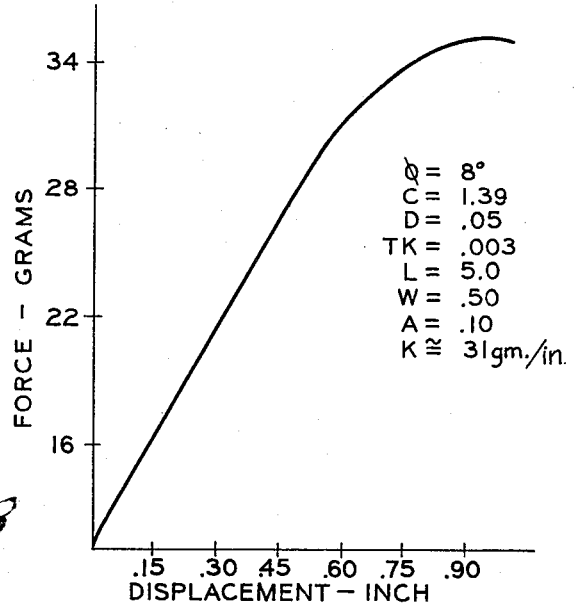
FIG. 8 is a diagram.

FIG. 8 is a diagram for a sensor 10 wherein $\phi$ is 8°, C. is 1.39", and the other dimensions are substantially the same as that of the sensors of FIGS. 6 and 7 except that the lateral step D is 0.05" and the thickness is 0.003". In this sensor, the spring rate is 31 grams per inch and the preload is 12 grams. The bend radius is 0.35". A comparison of this figure with FIGS. 6 and 7 indicates the effects of a change in angle $\phi$ and a change in the dimension D.

Figure 9:
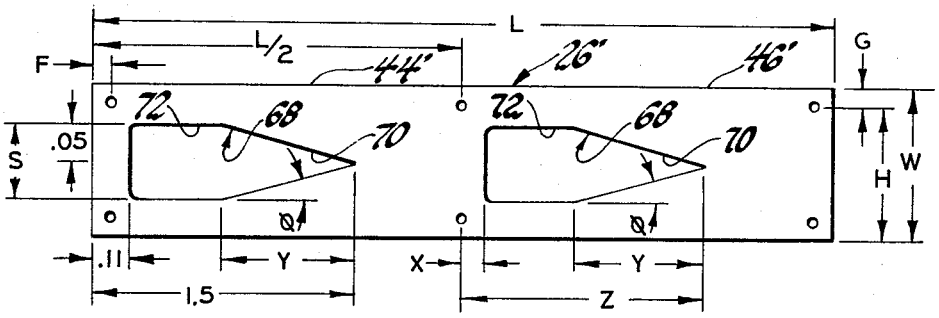
FIG. 9 is a view of a band of another embodiment.

FIG. 9 shows an alternate embodiment wherein the band 26' includes cut outs 68 in the forward and rearward band loops 44' and 46' to provide the effective varying width sections. Each cut out includes a tapered portion 70 which opens to a rectangular portion 72, both portions being symmetrical about the longitudinal center line of the band 26'. As with the band 26, only one cut out 68 need be provided. If both cut outs 68 are provided, they need not be of the same shape provided, of course, that the cut out 68 in the bands 26' and 28' are of the same shape and are symmetrically located in like band end loops.

Certain of the dimensions of the band 26' are indicated in FIG. 5. The dimensions L,L/2, W, F, G, $\phi$ and H are the same as previously set forth in conjunction with the band 26 shown in FIG. 5. Also as previously set forth in conjunction with the band 26 shown in FIG. 5, $\phi$ need not be the same for the cut outs 68 in the loops 44' and 46'. The dimension R is 0.06" to 0.08" and the dimension S is 0.10". The dimension X is 0.05", the dimension Y is 0.356", the dimension Z is 1.44" and the angle $\phi$ is 8°. The band is 0.003 thick. The preload and spring rate values of the band 26' can be varied by varying the dimension S, the dimension Y, the dimension Z and angle $\phi$ since the portion 72 is equivalent to the island 60 or 62 of the band 26 and the portion 70 is equivalent to the section 56 or 58.

Thus this invention provides a roller band sensor having effective varying width roller bands to attain predetermined spring rates and preloads. Effective varying width roller bands may include tapered sections, as the sections 56 and 58 or may include cut outs such as the cut outs 68 and the effective varying width sections need be provided in like end loops of the roller bands. The effective varying width sections are, of course, symmetrical about the center lines of the bands and the shape and dimensions thereof as well as the thickness of the band and the bend radius of the loops are determined in accordance with the values desired for the spring rate and preload of the sensor.

Thus this invention provides an improved roller band sensor.

The embodiments of the invention in which an exclusive property or privilege is claimed are defined as follows:

1. A sensor comprising, in combination, a housing including a pair of spaced planar bearing portions, a pair of flexible bands of planar spring material disposed between the bearing portions and forced thereby into generally elongate shape, the adjacent portions of the bands abutting each other and the remote portions of the bands each abutting a respective bearing portion, means securing the abutting portions to each other, means securing the remote portion of each band to a respective bearing portion whereby each band is divided into respective first and second end loops intermediate the adjacent and remote portions thereof, means limiting movement of the bands in one direction to establish a preload position of the bands, a velocity change of predetermined extent applied to the bands causing said bands to concurrently roll relative to each other along a respective bearing portion and translate from the preload position in an opposite directon to actuated position, means actuated upon movement of the bands to the actuated position to indicate the occurrence of such a velocity change of predetermined extent, like end loops of each band having a reduced effective width symmetrical section contiguous like portions of each such band to provide complementary integral preload forces biasing the bands in the one direction to the preload position and resisting movement of the bands in the opposite direction to actuated position by applied velocity changes.

2. A sensor comprising, in combination, a housing including a pair of spaced planar bearing portions, a pair of flexible bands of planar spring material disposed between the bearing portions and forced thereby into generally elongate shape, the adjacent portions of the bands abutting each other and the remote portions of the bands each abutting a respective bearing portion, means securing the abutting portions to each other, means securing the remote portion of each band to a respective bearing portion whereby each band is divided into respective first and second end loops intermediate the adjacent and remote portions thereof, means limiting movement of the bands in one direction to establish a preload position of the bands, a velocity change of predetermined extent applied to the bands causing said bands to concurrently roll relative to each other along a respective bearing portion and translate from the preload position in an opposite direction to actuated position, means actuated upon movement of the bands to the actuated position to indicate the occurrence of such a velocity change of predetermined extent, each band having a reduced effective width symmetrical section contiguous the adjacent portion thereof to provide complementary integral preload forces biasing the bands in the one direction to the preload position and resisting movement of the bands in the opposite direction to actuated position by applied velocity changes.

3. A sensor comprising, in combination, a housing including a pair of spaced planar bearing portions, a pair of flexible bands of planar spring material disposed between the bearing portions and forced thereby into generally elongate shape, the adjacent portions of the bands abutting each other and the remote portions of the bands each abutting a respective bearing portion, means securing the abutting portions to each other, means securing the remote portion of each band to a respective bearing portion whereby each band is divided into respective first and second end loops intermediate the adjacent and remote portions thereof, means limiting movement of the bands in one direction to establish a preload position of the bands, a velocity change of predetermined extent applied to the bands causing said bands to concurrently roll relative to each other along a respective bearing portion and translate from the preload position in an opposite direction to actuated position, means actuated upon movement of the bands to the actuated position to indicate the occurrence of such a velocity change of predetermined extent, each band having reduced effective width sections arranged asymetrically thereof and providing complementary integral preload forces biasing the bands in the one direction to the preload position and resisting movement of the bands in the opposite direction to actuated position by applied velocity changes.

4. A sensor comprising, in combination, a housing including a pair of spaced planar bearing portions, a pair of flexible bands of planar spring material disposed between the bearing portions and forced thereby into generally elongate shape, the adjacent portions of the bands abutting each other and the remote portions of the bands each abutting a respective bearing portion, means securing the abutting portions to each other, means securing the remote portion of each band to a respective bearing portion whereby each band is divided into respective first and second end loops intermediate the adjacent and remote portions thereof, means limiting movement of the bands in one direction to establish a preload position of the bands, a velocity change of predetermined extent applied to the bands causing said bands to concurrently roll relative to each other along a respective bearing portion and translate from the preload position in an opposite direction to actuated position, means actuated upon movement of the bands to the actuated position to indicate the occurrence of such a velocity change of predetermined extent, like end loops of each band having opposite edge portions thereof symmetrically tapered toward each other contiguous the remote portions thereof to provide complementary integral preload forces biasing the bands in the one direction to the preload position and resisting movement of the bands in the opposite direction to actuated position by applied velocity changes.

5. A sensor comprising, in combination, a housing including a pair of spaced parallel linear bearing portions, a pair of spring bands of planar material arranged in FIG. 8 configuration between the bearing portions and forced thereby into elongate shape having generally linear adjacent portions abutting each other and generally linear remote portions, each abutting a respective bearing portion, the linear portions of each band being connected by forward and rearward end loops of elastica shape, means securing the abutting linear portions to each other, means securing each linear remote portion to a respective bearing portion, means limiting movement of the bands in one direction to establish a preload position of the bands, a velocity change of predetermined extent applied to said bands causing said bands to concurrently roll relative to each other along a respective bearing portion and translate from the preload position in an opposite direction to actuated position as said forward loops form continuations of said remote linear portions and said rearward loops form continuations of said adjacent linear portions, each band having like portions of at least one respective loop symmetrically cut away adjacent a linear portion to provide a reduced effective width symmetrical section and resultant complementary integral forces biasing the bands to the preload position and resisting movement of the bands to actuated position by applied velocity changes.

* * * * *